United States Patent [19]

Nordlof et al.

[11] Patent Number: 4,804,898

[45] Date of Patent: Feb. 14, 1989

[54] STOCK FEED APPARATUS

[75] Inventors: Richard D. Nordlof, Rockford; Gary D. Reding, Roscoe; Jeffery S. MacDonald, Cherry Valley, all of Ill.

[73] Assignee: Rapid-Air Corporation, Rockford, Ill.

[21] Appl. No.: 158,868

[22] Filed: Feb. 22, 1988

[51] Int. Cl.[4] ..... G05B 19/18

[52] U.S. Cl. ..... 318/569; 318/6; 318/571; 318/603; 242/190; 226/42

[58] Field of Search ..... 318/569, 571, 6, 603; 226/42; 242/190

[56] References Cited

U.S. PATENT DOCUMENTS

| | | | |
|---|---|---|---|
| 3,637,123 | 1/1972 | Jones, Jr. | 242/42 |
| 4,335,336 | 6/1982 | Fillippini | 318/6 |
| 4,391,190 | 7/1983 | Metzler | 318/603 X |
| 4,401,923 | 8/1983 | O'Gwynn | 318/6 |
| 4,491,777 | 1/1985 | Beck et al. | 318/571 |
| 4,565,952 | 1/1986 | Kaiko et al. | 318/6 X |
| 4,578,621 | 3/1986 | Nordlof | 318/6 |
| 4,739,948 | 4/1988 | Rodal et al. | 318/6 X |

*Primary Examiner*—Benjamin Dobeck
*Attorney, Agent, or Firm*—Vernon J. Pillote

[57] ABSTRACT

A stock feed apparatus for feeding strips of stock to or from a stock processing machine to maintain a loop in the stock. The feed means is arranged to feed stock to or from the loop at speed correlative with the amplitude of a control voltage applied to the motor control. The stock loop sensor produces a first digital signal when the loop exceeds a first limit and a second digital signal when the loop exceeds a second limit. A loop control circuit is operative in response to the first digital signal to apply a control voltage of a first preselected amplitude to the motor control to drive the feed apparatus at a first speed until the loop moves away from the first limit and responsive to the second digital signal to apply a control voltage of a second preselected amplitude to drive the feed apparatus at a second speed until the loop moves away from the second limit. The loop control circuit also includes an up/down counter device and an analog switch device that is for applying a variable control voltage to the motor controller, when the loop is intermediate its first and second limits, and which is operative in response to the first digital signal to change the amplitude of the variable control voltage a step towards the first amplitude and operative in response to the second digital signal to change the amplitude to the variable control voltage a step toward the second preselected amplitude.

19 Claims, 2 Drawing Sheets

STOCK FEED APPARATUS

BACKGROUND OF THE INVENTION

The invention relates to stock feed apparatus for feeding strip stock to or from a stock processing machine to maintain a loop in the stock.

In the feeding of strip stock to or from a stock processing machine such as a punch press, it is common practice to operate the stock feed means to maintain a slack loop in the stock in order to accommodate the intermittent transfer of the stock through the processing machine. The stock feed apparatus may comprise a power operated stock payout or rewind reel that effects advance of stock by winding or unwinding stock from a coil. The stock advancing apparatus can also comprise powered stock feed rollers or powered stock straightening rollers.

Various systems have heretofore been made for sensing the size of the stock loop and for driving the stock feed apparatus in a manner to maintain the stock loop between predetermined limits. In some, such as disclosed in U.S. Pat. No. 4,578,621, a stock loop sensor in the form of a dancer arm is arranged to sense the size of the stock loop and produce an analog control voltage for driving the stock feed apparatus at a speed proportional to the size of the stock loop, to maintain the stock loop within predetermined limits. Stock feed controls have also been made in which the stock loop sensor provides a digital signal when the stock loop exceeds a predetermined minimum and maximum size limits. Some prior stock feed apparatus having digital input utilize the digital input signals to start the stock feed apparatus when the stock reaches a predetermined minimum limit and to stop the stock feed apparatus when the stock loop reached a predetermined maximum limit. However, because of the rapid advance of the stock through the stock processing machine, it is necessary to rapidly cycle such on/off feed controls. It has also been proposed, as disclosed in U.S. Pat. No. 3,637,123, to provide a stock feed apparatus having a photoelectric loop size sensor for sensing when the loop size increases or decreases relative to a reference size, and which produces an alternating on/off signal having a frequency determined by the number of times the size of the loop increases or decreases relative to the reference size, with means for converting the on/off signal to an analog signal proportional to the frequency of the on/-off signal, and means responsive to the analog signal for adjusting the speed of the feed means to maintain the size of the slack loop between predetermined limits.

SUMMARY OF THE INVENTION

It is an object of the present invention to provide a stock feed apparatus for feeding strip stock to or from a stock processing machine, which is operative in response to a digital signal from the stock loop sensor to drive a stock feed apparatus at a speed to maintain a loop in the stock between the stock feed apparatus and the processing machine under widely varying operating conditions of the processing machine and in a manner to minimize on/off cycling of the stock feed apparatus.

Accordingly, the present invention provides a stock feed apparatus for feeding strip stock to or from a stock processing machine to maintain a loop with the stock including motor means for driving the stock feed apparatus and motor control means operative to energize the motor means and drive the stock feed apparatus at a speed correlative with the amplitude of a control voltage applied to the motor control means, and input circuit means including loop size sensing means for producing a first digital signal when the loop size exceeds a first limit and for producing a second digital signal when the loop size exceeds a second limit. The stock feed apparatus includes a means for generating and applying a control voltage to the motor control means to control the loop size and which includes a means responsive to the first digital signal for applying a control voltage of a first preselected amplitude to the motor control means to drive the feed means at a first speed until the loop moves away from the first limit, means responsive to the second digital signal for applying a control voltage of a second preselected amplitude to the motor control means to drive the feed means at a second speed until the loop moves away from the second limit, and a variable voltage means operative when the loop is intermediate the first and second limits for applying a variable control voltage to the motor control means of an amplitude that is variable in a plurality of steps intermediate the first and second preselected amplitudes. The variable voltage means includes up/down counter means and analog switch means operative in response to the first digital signal to change the amplitude to the variable voltage a step toward the first preselected amplitude and operative in response to the second digital signal to change the amplitude of the variable control voltage a step toward the second preselected amplitude.

The stock feed apparatus can be utilized with various different digital type stock loop sensors including continuity, eddy current, ultrasonic, limit switch, photoelectric, and capacitance type sensors. The input circuit means of the apparatus advantageously includes an optically coupled isolator device individual to each of the first and second digital signals, and a power supply for the input circuits of the optically coupled isolator devices, which power supply is isolated from the power supply for the output circuits of the optically coupled isolator devices, to minimize shock hazards.

DESCRIPTION OF PREFERRED EMBODIMENT

Figure 1A:
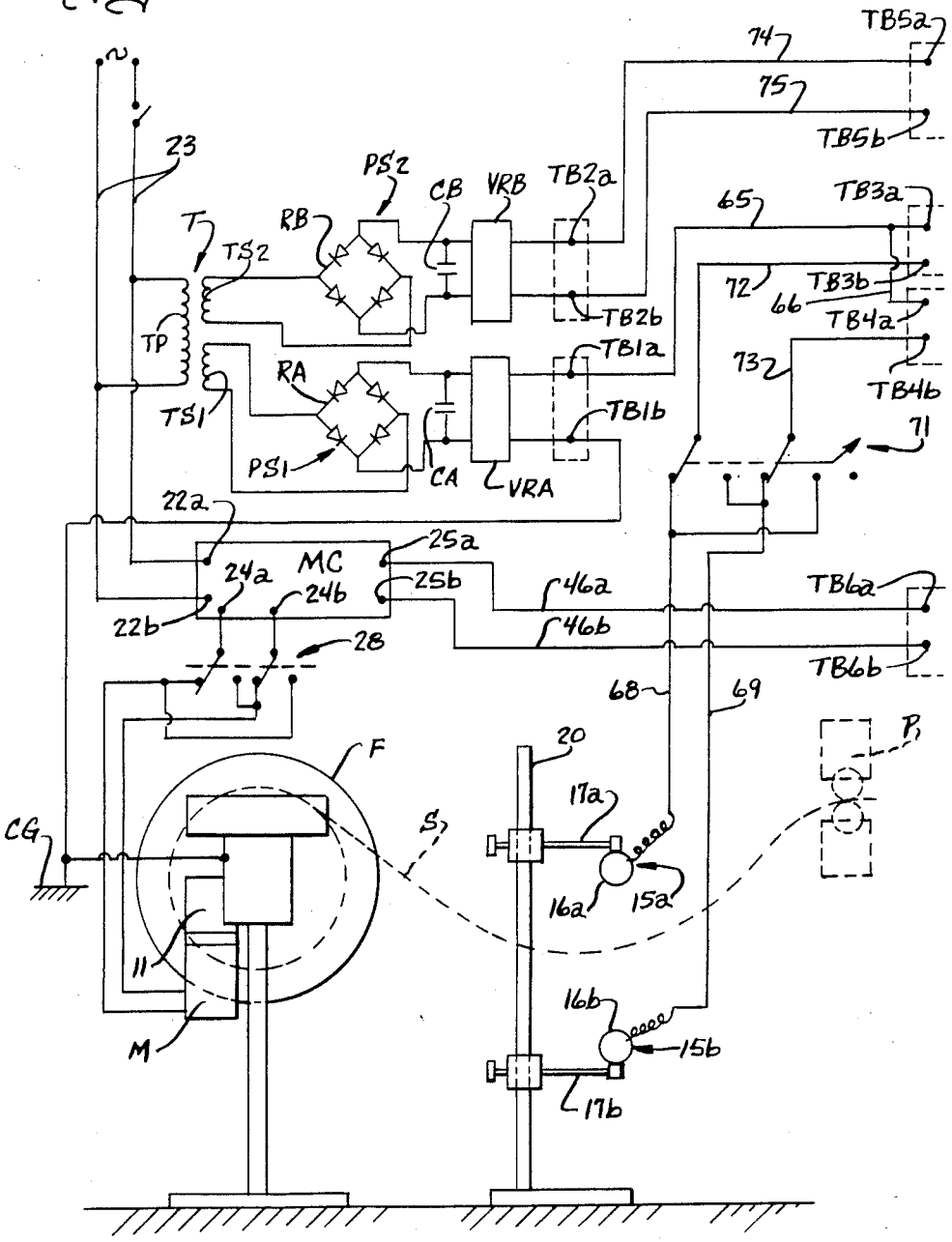
FIGS. 1A and 1B are two parts of a schematic drawing of the stock feed apparatus and control circuit therefor.

The present invention relates to a stock feed apparatus for feeding strip stock to or from a stock processing machine to maintain a loop in the stock. The stock feed apparatus F diagrammatically illustrated in FIG. 1 is in the form of a stock reel which is adapted to feed stock S to or from a stock processing machine such as a punch press diagrammatically illustrated at P. While the stock feed apparatus is herein illustrated in the form of a powered stock reel, it is to be understood that the stock feed apparatus could also comprise powered stock feed rollers or powered stock straightening rollers. The powered stock feed apparatus F is driven by a drive motor M through a speed reducer drive 11 at a speed correlative with the speed of the motor and loop size sensing means is provided for sensing the size of a loop in the stock between the feed means F and the stock processing machine P, and for producing a first digital signal when the loop size exceeds a first limit and for producing a second digital signal when the loop size exceeds a second limit. In the embodiment illustrated, the loop size sensing means includes a first sensor 15*a* for producing a first digital signal when the loop size exceeds a predetermined upper limit and a second sensor 15*b* for producing a second digital signal when the loop size exceeds a predetermined lower limit. The sensors diagrammatically illustrated in FIG. 1A are of the conductivity type and include an upper probe 16*a* of electrically conductive material which is supported by and insulated from a supporting arm 17*a*, and a lower probe 16*b* which is supported by and insulated from an arm 17*b*. The arms 17*a* and 17*b* are conveniently mounted for vertical adjustment on a post 20, to enable adjustment of the upper and lower limits of the stock loop. While continuity type probes are herein illustrated, it is to be understood that the upper and lower sensors may also be eddy current type sensors, ultrasonic sensors, limit switches, optical sensors or capacitance type sensors which are arranged to produce a digital output signal when the stock loop moves into predetermined proximity to the sensor.

The drive motor M is a reversible electric drive motor to enable rotation of the feed means in either direction and is preferably a D.C. electric motor that can be reversibly operated on direct current such as a permanent-magnet motor or shunt wound D.C. motor. A motor speed control MC is provided for the motor M and, as schematically shown in FIG. 1A, the motor speed control has power supply terminals 22*a* and 22*b* connected to a source of power such as an A.C. power supply line 23, and output terminals 24*a* and 24*b* arranged to be connected to the reversible motor M. The motor speed control MC also has input terminals 25*a* and 25*b* and the motor speed control is arranged to produce an output voltage at the output terminals 24*a* and 24*b* that is correlative in amplitude with the input signal applied to the input terminals. D.C. motor speed controls suitable for use in controlling operation of D.C. motors such as are used for driving stock feed apparatus are well known and commercially available from various different manufacturers. The motor speed control may, for example, be of the type sold by K.B. Electronics, Inc. of Brooklyn, N.Y. under the tradename KBIC Solid State D.C. Motor Speed Control. The voltage at the output terminals 24*a* and 24*b* of the motor control varies in amplitude with the amplitude of the D.C. signal or control voltage applied to the input terminals 25*a*, 25*b*, but does not change polarity. A polarity reversing switch 28 is provided between the motor controller and the motor for reversing the polarity of the voltage applied to the motor.

Figure 1B:
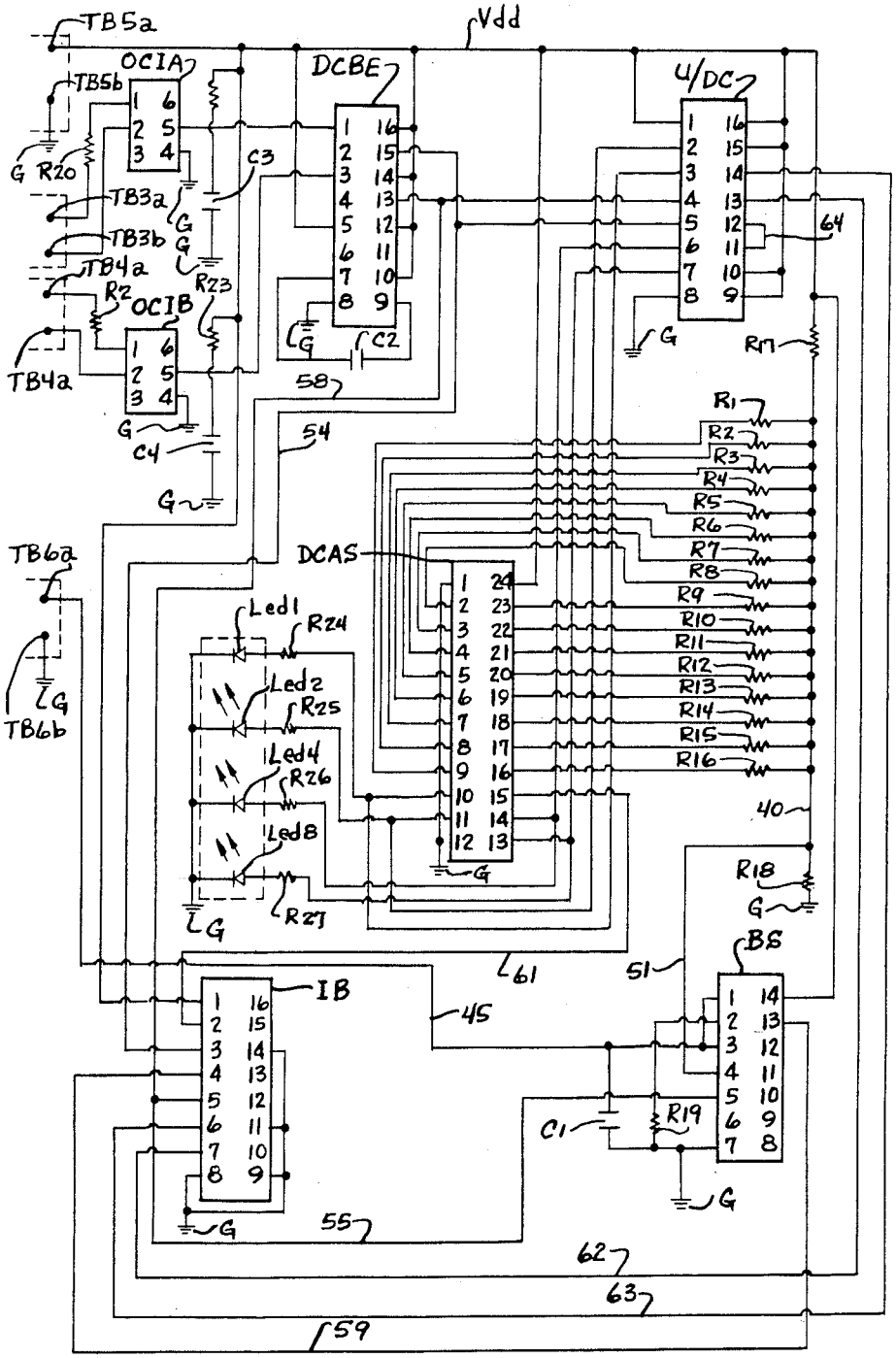

A control voltage circuit for generating and applying a control voltage to the input terminals 25*a* and 25*b* of the motor controller MC is shown in FIG. 1B. The control voltage circuit has an input section connected to the loop size sensors 15*a*, 15*b* and which is arranged to produce a first digital signal when the loop size exceeds a first limit and to produce a second digital signal when the loop size exceeds a second limit. The input section of the control voltage circuit advantageously includes a pair of optically coupled isolator devices designated OCI-A and OCI-B for electrically isolating the loop sensors 15*a* and 15*b* from the motor control circuit, and a digital contact bounce eliminator designated DCBE for eliminating extraneous level changes that result from bounce in mechanical contacts. The sensors 15*a* and 15*b* are connected through the optically coupled isolator devices OCI-A and OCI-B to the digital contact bounce eliminator DCBE to produce a first digital electrical signal at pin number 15 of the DCBE, hereinafter sometimes referred to as a count-up signal, when the stock loop exceeds a first preselected limit and to produce a second digital electrical signal at pin 13 of DCBE, hereinafter sometimes referred to as a count-down signal, when stock loop exceeds a second limit. The control voltage circuit is adapted to generate and apply a control voltage to the input terminals 25*a* and 25*b* of the motor control means to control the loop size in response to the digital signals at the output pins 15 and 13 of the digital contact bounce elimanator DCBE. The means for generating and applying a control voltage includes a means responsive to the first digital signal appearing at one of the output pin 15 of the DCBE, produced when the loop size exceeds a first limit, to apply a control voltage of a first preselected amplitude to the input terminals 25*a* and 25*b* of the motor control MC to drive the feed means at a first speed until the loop moves away from the first limit; a means responsive to the second digital signal appearing at a second output pin 13 of the DCBE, produced when the loop size exceeds a second predetermined limit, for applying a control voltage of a second preselected amplitude to the motor control means to drive the feed means at a second speed until the loop moves away from the second limit, and a variable voltage means operative when the loop is intermediate the first and second limits for applying a variable control voltage to the input terminals of the motor control MC of an amplitude that is variable in a plurality of steps intermediate the first and second preselected amplitudes. The variable voltage means includes an up/down counter means designated U/D C and an analog switch means designated DCAS that are operative in response to the first digital signal to change the amplitude of the variable control voltage a step toward the first preselected amplitude and operative in response to the second digital signal to change the amplitude of the variable control voltage a step toward the second preselected amplitude. In this manner, the level of the variable control voltage applied to the motor control MC when the loop is intermediate its upper and lower limits is changed a step each time the loop exceeds a first or a second limit to change the speed of the feed means in a manner that will decrease the differential between the speed of advance of the stock by the feed means and the speed at which the stock is advanced by the processing machine. Thus, the variable control voltage is changed in stepped fashion toward a control voltage level that will drive the feed means to feed stock at a speed closely approximating the speed at which the stock is advanced through the stock processing machine.

The up/down counter U/D C is of the type having individual up and down count inputs and a coded difference count output. The counter may, for example, be an RCA up/down counter type 40193 having an up count input at pin 5 and a down count input at pin 4 and a binary coded output Q1–Q4 at pins 3, 2, 6 and 7 respectively. The digitally controlled analog switch DCAS is of the type that implements a multiple-pole single throw electronic switch having a common in/out pin and a plurality of channel in/out pins. The digitally controlled analog switch DCAS may, for example, be an RCA type 4067 analog multiplexer/demultiplexer having four binary coded control inputs at pins 10, 11, 14 and 15 respectively connected to the Q1–Q4 counter outputs appearing at pins 3, 2, 6 and 7 respectively of the up/down counter U/D C. The DCAS has a common in/out at pin 1 and in/out channels 0–15 at pins 9–2 and 16–23 respectively. This digitally controlled analog switch also has an inhibit input at pin 15 and is operative in response to a logic 1 present at the inhibit input to turn all of the channels off. Channels 0–7 appearing at pins 9–2 respectively are connected to respective resistors R1–R8, and channels 8–15 appearing at pins 23–16 respectively are connected to respective resistors R9–R16. The analog switch will establish a circuit between the common in/out pin 1 and one of the in/out channels 0–15, corresponding to the combination of binary control inputs applied to input pins 10, 11, 14 and 13.

The control voltage circuit has a D.C. supply voltage conductor Vdd connected to terminals TB5*a* and a reference voltage conductor designated by the ground symbol and the letter G connected to terminal TB5*b*. Resistors R1–R16 are connected in a voltage divider circuit to produce a stepwise variable control voltage at control conductor 40. As shown in FIG. 1B, a resistor R17 is connected between supply voltage conductor Vdd and a control conductor 40 and the control conductor is connected through resistor R18 to circuit ground G. One end of each of the resistors R1–R16 is connected to control conductor 40 and, as previously described, the other end of resistors R1–R16 are connected to a respective one of the in/out pins 9–2 and 23–16 of the digitally controlled analog switch DCAS, and the common in/out pin of DCAS is connected to the circuit ground G. The digitally controlled analog switch DCAS is thus operable to connect a selected one of the resistors R1–R16 to ground and in parallel with resistor R18. The values of resistors R17 and R18 are selected so that, when all of the switches in DCAS are open and none of the resistors R1–R16 are connected in parallel with resistor R18, the voltage at control conductor 40 will be at a level such as to drive the feed means at a high speed substantially above the maximum speed of advance of stock through the stock processing machine, herein sometimes referred to as full speed. The digitally controlled analog switch DCAS is operative in response to a combination of the binary control inputs at in/out pins 10, 11, 14, and 13, to connect a corresponding one of the channel in/out pins to the common input and thereby connect a corresponding one of the resistors R1–R16 to ground in parallel with resistor R18. In this manner, the voltage appearing at control conductor 40 is adjusted in step fashion by the digitally controlled analog switch in response to the up/down counter.

The voltage at control conductor 40 is applied through a switch means designated BS in FIG. 1B to the motor control MC. Switch BS is preferably a bilateral switch device consisting of a plurality of independent switches. The switch device BS may, for example, be an RCA type 4066 Quad Bilateral Switch having one control input at pin 13 arranged to control a bilateral switch between pins 1 and 2 to turn the switch off in response to a logic 0 and to turn the switch on in response to a logic 1. The switch BS also includes a second bilateral switch having a control input at pin 5 operative to turn the switch between pins 3 and 4 off in response to a logic 0 and on in response to a logic 1 at the control pin. Control conductor 40 of the voltage divider is connected through a conductor 51 to pin 4 of the switch BS and pin 3 is connected through a conductor 45 to a terminal block having a positive terminal TB6*a* and a grounded terminal TB6*b*, and terminals TB6*a* and TB6*b* are connected through conductors 46*a* and 46*b* to the input terminals 25*a* and 25*b* of the motor controller MC. The down-count signal appearing at pin 13 of the contact bounce eliminator DCBE is applied through conductors 54 and 55 to control input pin 5 of the switch BS in a manner to turn the switch between pins 3 and 4 of switch BS off when a digital signal appears at pin 13 of the contact bounce eliminator device DCBE, and thereby interrupt application of control voltage to the input terminal 25*a* of the motor controller. The down-count signal at pin 13 of the contact bounce eliminator DCBE is also applied through an inverting type buffer IB to control input pin 13 of the bilateral switch BS to close the switch between pins 1 and 2. Pin 2 of switch BS is connected through a resistor R19 to ground to rapidly drop the voltage at the input of the motor controller, when the switch between pins 1 and 2 of the bilateral switch is closed. A capacitor C1 is connected from the conductor 45 to ground.

The inverting buffer IB may, for example, be of the RCA type 4049 having an input at pin 5 connected to line 54 and an inverted output at pin 4 connected through line 59 to the control input pin 13 of the bilateral switch BS. The inverting type buffer IB also has a control input at pin 3 connected through line 58 to the pin 15 of DCBE, with an inverted output at pin 2 connected through a line 61 to the inhibit pin 15 of the digitally controlled analog switch DCAS. Thus, an up-count digital signal at pin 15 of DCBE will turn all the switches in DCAS off to thereby apply the full voltage appearing at control conductor 40 to the input terminal 25*a* of the motor control MC. A down-count digital signal appearing at pin 13 of DCBE will turn the switch between pins 3 and 4 of the bilateral switch BS off and will also close the switch between pins 1 and 2 of the bilateral switch BS to connect line 45 to ground through resistor R19. When the stock loop is intermediate its upper and lower limits, the switch between pins 3 and 4 of the bilateral switch BS is closed and the switch between pins 2 and 3 of BS is open. The DCAS will then connect a selected one of the resistors R1–R16 to ground determined by the Q output of the up/down counter applied to the input terminals of the digitally controlled analog switch DCAS.

The up/down counter U/DC has a "borrow" output at pin 13 and a "reset" input at pin 14. Borrow pin 13 of U/DC is connected through conductor 62 to input pin 7 of inverter buffer IB, and the inverted output at pin 6 of IB is applied through conductor 63 to the reset pin 14 of U/DC to reset the counter to zero in the event the counter counts down to its minimum count. Counter U/bc also has a "carry" output at pin 12 and a "preset enable" input at pin 11 and pin 12 is connected by conductor 64 to pin 11 to preset the counter to maximum count in the event the counter counts up to its maximum count.

As previously described, the input circuit advantageously includes optically coupled isolators OCI-A and OCI-B. The optically coupled isolators have a light emitting diode input and a photo responsive semi-conductor output and may, for example, be of the type distributed by TRW Electronic Components Group, Type 4N29. Such optically coupled isolators have a light emitting diode connected between input pins 1 and 2 and a photodarlington output between output pins 4 and 5. Separate power supplies PS1 and PS2 are advantageously provided for the input circuits and output circuits of the optically coupled isolators OCI-A and OCI-B and the power supplies PS1 and PS2 are electrically isolated from each other. As shown in FIG. 1A the power supplies PS1 and PS2 are connected to separate electrically isolated secondary windings TS1 and TS2 of a transformer T having its primary winding TP connected to the A.C. power supply lines 23. Power supply PS1 includes a full wave bridge rectifier RA connected to secondary winding TS1 and a filter capacitor CA and voltage regulator VRA and power supply PS2 similarly includes a full wave rectifier RB, filter capacitor CB and voltage regulator VRB. Power supply PS1 has output terminals TB1*a* and TB1*b*, and power supply PS2 has output terminals TB2*a* and TB2*b*. The optically coupled isolator OCI-A has an input pin 1 connected through a current limiting resistor R20 to terminal TB3*a* and input pin 2 connected to a terminal TB3*b*. Optically coupled isolator OCI-B has an input pin 1 connected through a current limiting resistor R21 to terminal TB4*a* and the other input pin 2 connected to terminal TB4*b*. Terminal TB1*a* of power supply PS1 is connected through conductor 65 to terminal TB3*a* and through conductor 66 to terminal TB4*a*. The other terminal TBl*b* of power supply PS1 is connected to a ground that is isolated from the ground G for the control circuit. When used with conductivity type sensors, the terminal TB1*b* of power supply PS1 is connected to chassis ground indicated by CG, which chassis ground is the chassis of the feed apparatus F. The stock loop sensors 15*a* and 15*b* are connected through lines 68 and 69 respectively and through a double-pole double-throw payout-rewind reversing switch 71 and lines 72, 73 to the terminals TB3*b* and TB4*b*. When the strip stock S contacts either probe 16*a* or probe 16*b*, it will establish a circuit between the chassis ground CG and the input pin 2 of the optically coupled isolator connected thereto through the reversing switch 71 to energize the respective photo emitting diode. For example, when the reversing switch 71 is in the position shown in FIG. 1A, contact of the strip with the upper probe 16*a* will energize the light emitting diode in OCI-A, and contact of the strip with the lower probe 16*b* will energize the light emitting diode in OCI-B. When the payout-rewind reversing switch 71 is moved to its other position, the operation of probes 16*a* and 16*b* is reversed so that the light emitting diode of OCI-A is energized when the loop exceeds its lower limit and the light emitting diode in OCI-B is energized when the loop exceeds its upper limit.

As previously described, power supply PS2 is electrically isolated from the power supply PS1 and is arranged to supply power to the output circuits of the optically coupled isolators and to the control voltage circuit. As shown in FIG. 1A, power supply PS2 has its output connected through lines 74 and 75 to terminals TB5*a* and TB5*b*. Terminal TB5*b* is connected to the circuit board ground G and terminal TB5*a* is connected to the positive voltage supply conductor vdd. As shown in FIG. 1B, the voltage supply vdd is connected through a dropping resistor R22 to output pin 5 of OCI-A and through dropping resistor R23 to output pin 5 of OCI-B. Capacitors C3 and C4 are connected between output pins 5 of OCI-A and OCI-B and circuit ground G. Positive voltage supply conductor Vdd is also connected to the appropriate positive voltage pins of digital contact bounce eliminator DCBE, up/down counter UDC, digitally controlled analog switch DCAS, inverter buffer IB, and bilateral switch BS. The output pin 5 of optically coupled isolator OCI-A is connected to pin 1 of the digital contact bounce eliminator and output pin 5 of OCI-B is connected to pin 3 of the digital contact bounce eliminator DCBE. The digital contact bounce eliminator DCBE may for example, be Motorola type 14490 which takes an input signal from a bouncing contact and generates a clean digital signal four clock periods after the input has stabilized. The bounce delay is adjustable by a capacitor C2 between pins 7 and 9 of the digital contact bounce eliminator. The digital contact bounce eliminator is operative in response to a digital input at pin 1 to produce a clean digital output at pin 15 and responsive to a digital input at pin 3 to provide a clean digital output at pin 13.

Means are advantageously provided to give a visual indication of the level of the analog control voltage being applied when the loop is intermediate its limits, and hence an indication of the speed of the feed means. As shown in FIG. 1B, a light emitting diode array including Led1, Led2, Led4 and Led8 are connected through current limiting resistors R24–R27 to the binary output pins 10, 11, 14 and 13 respectively of the digitally controlled analog switch DCAS, to indicate the speed of a feed apparatus in binary code.

The foregoing circuit has been produced and utilized with excellent results. The value of the circuit components used in this reduction to practice is shown in Table I below. It should be noted that these are representative circuit values and that the invention is not intended to be limited to these particular values.

TABLE I

| | | | |
|---|---|---|---|
| R1 | 10 ohms | R19 | 51 ohms |
| R2 | 82 ohms | R20 | 1K ohms |
| R3 | 180 ohms | R21 | 1K ohms |
| R4 | 300 ohms | R22 | 4.3K ohms |
| R5 | 430 ohms | R23 | 4.3K ohms |
| R6 | 560 ohms | R24 | 430 ohms |
| R7 | 680 ohms | R25 | 430 ohms |
| R8 | 910 ohms | R26 | 430 ohms |
| R9 | 1.1K ohms | R27 | 430 ohms |
| R10 | 1.2K ohms | Cl | .01 Uf |
| R11 | 1.5K ohms | C2 | .1 Uf |
| R12 | 2.0K ohms | C3 | .22 Uf |
| R13 | 2.7K ohms | C4 | .22 Uf |
| R14 | 3.6K ohms | CA | 220 Uf |
| R15 | 6.8K ohms | CB | 220 Uf |
| R16 | 16K ohms | | |
| R17 | 2.2K ohms | | |
| R18 | 8.2K ohms | | |

From the foregoing it is thought that the construction and operation of the stock feed apparatus will be readily understood. The voltage at the output pins 5 of the optically coupled isolators OCI-A and OCI-B is normally at full supply voltage from conductor Vdd. Assuming that the payout-rewind switch 71 is in the position shown in FIG. 1A, the stock loop sensor 15*a* will complete a circuit to chassis ground LCG for the associated optical coupled isolator OCI-A to energize the photo emissive diode and drop the voltage at output pin 5 of OCI-A to logic 0. When the stock loop moves away from sensor 15*a*, the input circuit of OCI-A is deenergized and output pin 5 returns to supply voltage or logic 1 condition. Similarly, the output at pin 5 of OCI-B will be at supply voltage until the loop exceeds a lower limit and actuates lower sensor 15*b*. When the lower sensor is actuated, the output at pin 5 of OCI-B drops to logic 0 and remains at logic 0 until the loop moves away from the lower limit. The digital contact bounce eliminator DCBE produces a digital output signal at pins 15 and 13 that correspond respectively to the digital input signal at pins 1 and 3 and the signals at pins 13 and 15 are respectively applied to the clock-up pin 5 and clock-down pin 4 of the up/down counter to cause the counter to count up or down in accordance with the input signals at pins 5 and 4 of the counter. The clock-up signal is also applied through line 58 to the input pin 3 of the inverter buffer IB, to apply an inverted output signal through conductor 61 to the inhibit input pin 15 of the digitally controlled analog switch DCAS. This opens all the switches in the DCAS to drive the feed means at full speed until the stock loop moves away from the upper limit and the voltage at terminal 15 of DCBE returns to logic 1 condition. A count-down signal at pin 13 of DCBE is applied through conductor 54 to pin 5 of the inverter buffer IB and through conductor 55 to input pin 5 of the bilateral switch BS. A logic 0 at input pin 5 of the bilateral switch BS opens the switch between pins 3 and 4 to interrupt supply of control voltage from line 51 to line 45, and a logic 1 signal at pin 13 of the bilateral switch BS closes the switch between pins 2 and 1 to connect pin 1 and hence conductor 45 to ground through resistor R19. This stops the feed means until the loop moves away from the lower sensor and the count-down signal returns to logic 1.

The digitally controlled analog switch CAS connects a selected one of the resistors R1–R16 in parallel with resistor R18, to change the level of the voltage appearing at control conductor 40 in accordance with the value of the selected resistor R1–R16. As will be seen from Table I, the values of resistors R1–R16 increases in steps so that the voltage at control conductor 40 is lowest when resistor R1 is in parallel with resistor R18 and highest when resistor R16 is in parallel with R18. Thus, the speed at which the feed means is driven when the stock loop is intermediate its upper and lower limits increases a step each time the up/down counter counts up and decreases a step each time the up/down counter counts down.

The embodiments of the invention in which an exclusive property or privilege is claimed are defined as follows:

1. In a stock feed apparatus for feeding strip stock to or from a stock processing machine to maintain a loop in the stock including, motor means for driving the stock feed apparatus and motor control means operative to energize the motor means and drive the feed apparatus at a speed correlative with the amplitude of a control voltage applied to the motor control means, input circuit means including loop size sensing means for producing a first digital signal when the loop size exceeds a first limit and for producing a second digital signal when the loop size exceeds a second limit, means for generating and applying a control voltage to the motor control means to control the loop size comprising:

(a) means responsive to said first digital signal for applying control voltage of a first preselected amplitude to the motor control means to drive the feed means at a first speed until the loop moves away from the first limit, (b) means responsive to said second digital signal for applying control voltage of a second preselected amplitude to the motor control means to drive the feed means at a second speed until the loop moves away from the second limit, (c) variable voltage means operative when the loop is intermediate said first and second limits for applying a variable control voltage to the motor control means of an amplitude that is variable in a plurality of steps intermediate said first and second preselected amplitudes, said variable voltage means including up/down counter means and analog switch means operative in response to said first digital signal to change the amplitude of the variable control voltage a step toward said first preselected amplitude and operative in response to said second digital signal to change the amplitude of the variable control voltage a step toward the second preselected amplitude.

2. A stock feed apparatus according to claim 1 including means responsive to said first digital signal for interrupting application of said variable control voltage to said motor control means when the loop size exceeds said first limit and means responsive to said second digital signal for interrupting application of said variable control voltage to said motor control means when the loop size exceeds said second limit.

3. A stock feed apparatus according to claim 1 wherein said loop position sensing means includes an upper loop position sensing means and a lower loop position sensing means, and reversing switch means connected to said upper and lower loop position sensing means and operative in one position to produce said first and second digital signals when the loop size respectively exceeds upper and lower limits and operative in a second position to produce said first and second digital signals when the loop size respectively exceeds lower and upper limits.

4. A stock feed apparatus according to claim 1 wherein said variable voltage means includes a plurality of discrete resistances, said analog switch means being connected to said discrete resistances to change the amplitude of the variable voltage in steps.

5. A stock feed apparatus according to claim 1 wherein said input circuit means includes first and second optically coupled isolator devices each having a light emitting semi-conductor input circuit and a photoresponsive semi-conductor output circuit, a first power supply means for supplying D.C. voltage to the output circuits of the first and second optically coupled isolator devices and second power supply means electrically isolated from the first power supply means for supplying D.C. voltage to the input circuits of the first and second optically coupled isolator devices, said stock loop sensing means including an upper loop position sensing means connected to the input circuit of one of the optically coupled isolator devices and a lower loop position sensing means connected to the input circuit of the other of the optically coupled isolator device.

6. A stock feed apparatus according to claim 1 wherein said stock loop sensing means includes an upper stock loop engaging probe and a lower stock loop engaging probe, said input circuit means including first and second optically coupled isolator devices each having a light emitting semi-conductor input circuit and a photoresponsive semi-conductor output circuit, a first power supply means for supplying D.C. voltage to the output circuits of the first and second optically coupled isolator devices, second power supply means electrically isolated from the first power supply means for applying D.C. voltage to the input circuits of the first and second optically coupled isolator devices, and means for connecting the upper and lower stock loop engaging probes to the input circuit of a respective one of the optically coupled isolator devices.

7. A stock feed apparatus according to claim 6 wherein said last mentioned means includes reversing switch means for reversibly connecting the upper and lower stock loop engaging probes to the input circuits of the first and second optically coupled isolator devices.

8. A stock feed apparatus according to claim 1 wherein the analog switch means is a digitally controlled analog switch device that implements a multiple-pole single-throw electronic switch having a common in/out terminal and a plurality of channel in/out terminals, said variable voltage mans including a plurality of discrete resistances each connected to a respective one of the channel in/out terminals of the analog switch device.

9. A stock feed apparatus according to claim 8 wherein said analog switch device has an inhibit input operative in response to an inhibit signal for turning off channel in/out terminals, said means for applying control voltage to the motor control means to drive the feed means at said first speed including means for applying an inhibit signal to the inhibit input of the analog switch device.

10. A stock feed apparatus according to claim 9 wherein said means for applying control voltage to the motor control means to drive the feed means at said second speed includes digitally controlled switch means operative to an open condition in response to said second digital signal.

11. A stock feed apparatus according to claim 1 wherein said second preselected amplitude of the control voltage is zero to stop driving the feed means.

12. In a stock feed apparatus for feeding strip stock to or from a stock processing machine to maintain a loop in the stock including, motor means for driving the stock feed apparatus and motor control means operative to energize the motor means and drive the feed apparatus at a speed correlative with the amplitude of a control voltage applied to the motor control means, input circuit means including loop size sensing means for producing a first digital signal when the loop size exceeds a first limit and for producing a second digital signal when the loop size exceeds a second limit, means for generating and applying a control voltage to the motor control means to control the loop size comprising:

(a) means responsive to said first digital signal for applying control voltage of a first preselected amplitude to the motor control means to drive the feed means at a first speed until the loop moves away from the first limit, (b) means responsive to said second digital signal for applying control voltage of a second preselected amplitude to the motor control means to drive the feed means at a second speed until the loop moves away from the second limit, (c) variable voltage means operative when the loop is intermediate said first and second limits for applying a variable control voltage to the motor control means of an amplitude that is variable in a plurality of steps intermediate said first and second preselected amplitudes, said variable voltage means including:

(i) an up/down counter device having individual up and down count inputs and operative and difference count output;

(ii) a digitally controlled analog switch device that implements a multiple-pole single-throw electronic switch having a plurality of in/out channels, the analog switch device having control input connected to the difference count output of the up/down counter device and said analog switch device being operative to establish a conductive path through one of the in/out corresponding to the difference count;

(iii) variable voltage generating means including a plurality of resistors each connected to a respective one of the channels of the analog switch device; means applying said first digital signal to one of the count inputs and said second digital signal to the other of the count inputs of the up/down counter device, (iv) said up/down counter device and analog switch device and variable voltage generating means being operative in response to said first digital signal to change the amplitude of the variable control voltage a step toward said first preselected amplitude and operative to response to said second digital signal to change the amplitude of the variable control voltage a step toward the second preselected amplitude.

13. A stock feed apparatus according to claim 12 wherein said analog switch device has an inhibit input operative in response to an inhibit signal for turning off all of the in/out channels, said means for applying control voltage to the motor control means to drive the feed means at said first speed includes means for applying an inhibit signal to the inhibit input of the analog switch.

14. A stock feed apparatus according to claim 13 wherein said means for applying control voltage to the motor control means to drive the feed means at said second speed includes digitally controlled switch means operative to an open condition in response to said second digital signal.

15. A stock feed apparatus according to claim 12 including means responsive to said first digital signal for interrupting application of said variable control voltage to said motor control means when the loop size exceeds said first limit, and means responsive to said second digital signal for interrupting application of said variable control voltage to said motor control means when the loop size exceeds said second limit.

16. A stock feed apparatus according to claim 12 wherein said loop position sensing means includes an upper loop position sensing means and a lower loop position sensing means, and reversing switch means connected to said upper and lower loop position sensing means and operative in one position to produce said first and second digital signals when the loop size respectively exceeds upper and lower limits and operative in a second position to produce said first and second digital signals when the loop size respectively exceeds lower and upper limits.

17. A stock feed apparatus according to claim 12 wherein said input circuit means includes first and second optically coupled isolator devices each having a light emitting semi-conductor input circuit and photo-responsive semi-conductor output circuit, a first power supply means for supplying D.C. voltage to the output circuits of the first and second optically coupled isolator devices and second power supply means electrically isolated from the first power supply means for supplying D.C. voltage to the input circuits of the first and second optically coupled isolator devices, said stock loop sensing means including an upper loop position sensing means connected to the input circuit of one of the optically coupled isolator devices and a lower loop position sensing means connected to the input circuit of the other of the optically coupled isolator device.

18. A stock feed apparatus according to claim 12 wherein said stock loop sensing means includes an upper stock loop engaging probe and a lower stock loop engaging probe, said input circuit means including first and second optically coupled isolator devices each having a light emitting semi-conductor output circuit, a first power supply means for supplying D.C. voltage to the output circuits of the first and second optically coupled isolator devices, second power supply means electrically isolated from the first power supply means for applying D.C. voltage to the input circuits of the first and second optically coupled isolator devices, and means for connecting the upper and lower stock loop engaging probes to the input circuit of a respective one of the optically coupled isolator devices.

19. A stock feed apparatus according to claim 18 wherein said last mentioned means includes reversing switch means for reversibly connecting the upper and lower stock loop engaging probes to the input circuits of the first and second optically coupled isolator devices.

* * * * *

UNITED STATES PATENT AND TRADEMARK OFFICE

CERTIFICATE OF CORRECTION

PATENT NO. : 4,804,898

DATED : February 14, 1989

INVENTOR(S) : Richard D. Nordlof et al

It is certified that error appears in the above-identified patent and that said Letters Patent is hereby corrected as shown below:

Claim 12, column 12, line 6, after "in/out" insert -- channels --.

Claim 13, column 12, line 31, after "switch" insert -- device --.

Signed and Sealed this

Fifteenth Day of August, 1989

*Attest:*

*Attesting Officer*

DONALD J. QUIGG

*Commissioner of Patents and Trademarks*